US005373607A

United States Patent [19]

Hwang

[11] Patent Number: 5,373,607

[45] Date of Patent: Dec. 20, 1994

[54] HAIR CLEANING DEVICE

[76] Inventor: Jyh-Shyan Hwang, 682, Yung An Road, Taoyuan, Taiwan, Prov. of China

[21] Appl. No.: 124,030

[22] Filed: Sep. 21, 1993

[51] Int. Cl.[5] ..... A47L 5/24

[52] U.S. Cl. ..... 15/344; 15/347

[58] Field of Search ..... 15/344, 347, 401, 402

[56] References Cited

U.S. PATENT DOCUMENTS

| | | | |
|---|---|---|---|
| 1,107,715 | 8/1914 | Sharpneck | 15/344 |
| 1,225,244 | 5/1917 | Hendricks | 15/402 |
| 2,753,434 | 7/1956 | Storm | 15/344 |
| 2,809,390 | 10/1957 | Gotzen | 15/344 |
| 3,903,564 | 9/1975 | Morinaga | 15/344 |
| 3,934,302 | 1/1976 | Mabuchi | 15/344 |
| 4,218,806 | 8/1980 | Cohn | 15/344 |
| 4,799,460 | 1/1989 | Kuhl | 15/344 |
| 5,074,006 | 12/1991 | Eremita | 15/344 |

FOREIGN PATENT DOCUMENTS

| | | | |
|---|---|---|---|
| 3521603 | 12/1986 | Germany | 15/344 |

*Primary Examiner*—David A. Scherbel
*Assistant Examiner*—Terrence R. Till
*Attorney, Agent, or Firm*—Bacon & Thomas

[57] ABSTRACT

A hair cleaning device comprised of a motor holder to hold an induced draft fan device and a DC power supply, a bottom shell covered on the motor holder at the bottom, a top cover covered on the motor holder at the top, the bottom shell having teeth for combing the hair and ventilation tubes for passing air, the top cover having a button for turning on the induced draft fan device, causing it to produce an induced draft for sucking up dust and dandruff from the hair into the bottom shell.

3 Claims, 5 Drawing Sheets

HAIR CLEANING DEVICE

BACKGROUND OF THE INVENTION

The present invention relates to a device for cleaning and smoothing the which, and has a suction fan for sucking up dust from the hair as it is operated to comb the hair.

Combs and hairbrushes are commonly used for cleaning and smoothing the hair. However, using a comb or hairbrush to clean the hair cannot effectively remove dust from the hair. In order to keep the hair clean, the hair must be regularly washed. However, it is not always possible to wash the hair when the hair is covered with dust.

SUMMARY OF THE INVENTION

The present invention eliminates the aforesaid problem by providing a suction fan device for a hairbrush. Dust is removed from the hair by means of the operation of the suction fan device as the hair is cleaned and smoothed with the hairbrush. The device of the present invention is simple in structure, and inexpensive to manufacture. All the electric component parts are concealed from sight and protected within the shell. Because the device is operated to comb the roots of the hair and because the output ends of the ventilation tubes on the bottom shell of the device are directed sideways, the tail of the hair will not be sucked into the device.

BRIEF DESCRIPTION OF THE DRAWINGS

FIG. 5 is similar to FIG. 3 but showing the switch switched on; and

DETAILED DESCRIPTION OF THE PREFERRED EMBODIMENT

Figure 1:
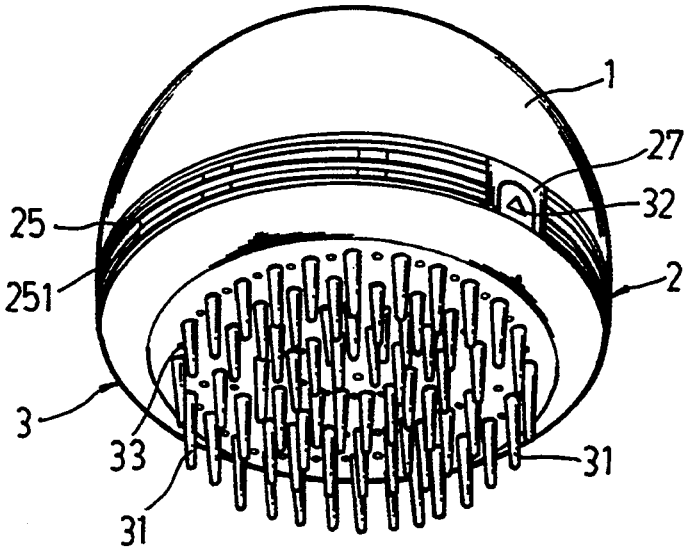
FIG. 1 is an elevational view of a hair cleaning device according to the preferred embodiment of the present invention.
Figure 2:
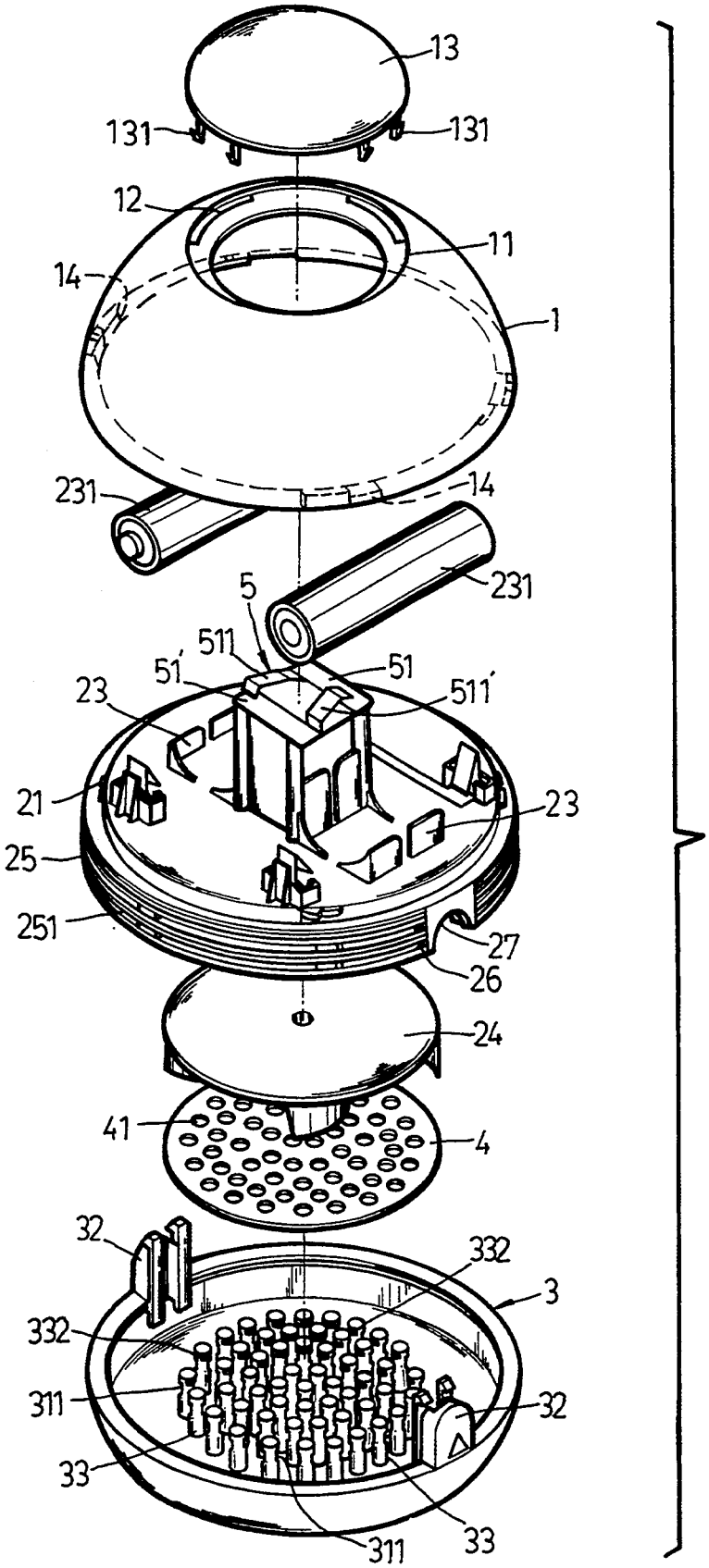
FIG. 2 is an exploded view of the hair cleaning device shown of FIG. 1.
Figure 3:
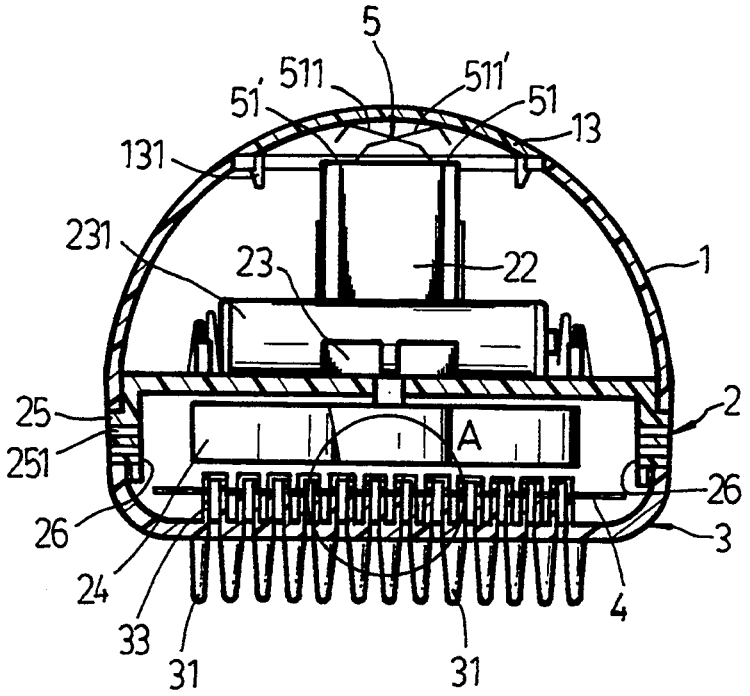
FIG. 3 is a sectional plan view of the hair cleaning device of FIG. 1.

Referring to FIGS. 1, 2, and 3, a device for cleaning the hair in accordance with the present invention is generally comprised of a top cover 1, a motor holder 2, a bottom shell 3, and a partition plate 4. The motor holder 2 is fastened inside the top cover 1 to hold a motor 22 and a battery chamber 23. A switch 5 is mounted on the motor holder 2 above the motor 22. A fan blade 24 is coupled to the output shaft (not shown) of the motor 22 at the bottom. A circular fan guard 25 is fastened to the motor holder 2 at the bottom around the fan blade 24. The bottom shell 3 covers the fan guard 25 at the bottom. The top cover 1 has a button 13 at the top pressed to turn on the switch 5.

Figure 4:
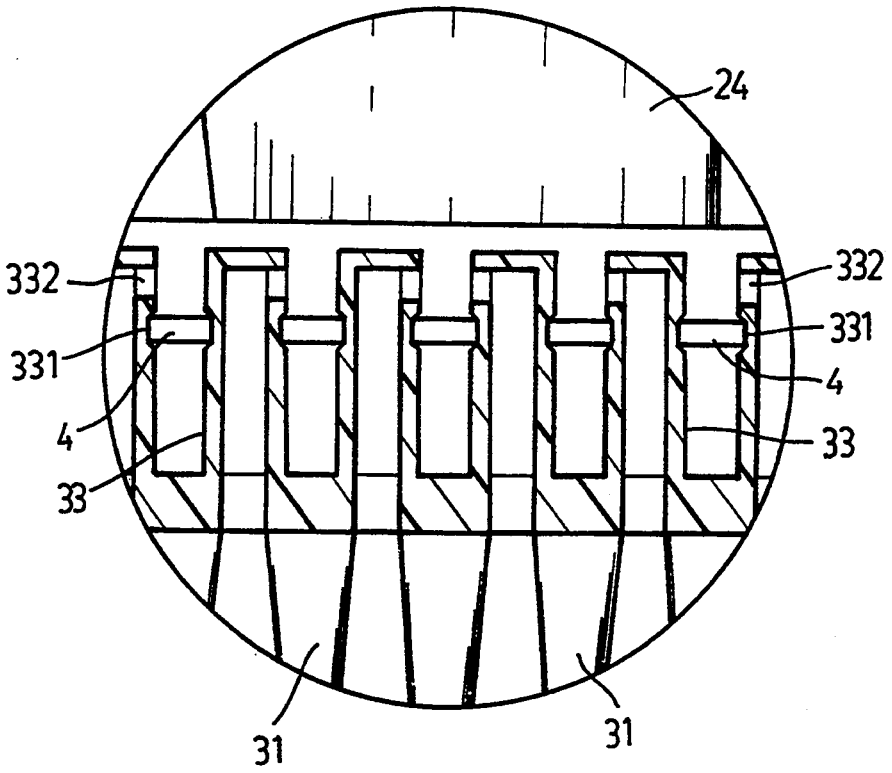
FIG. 4 is an enlarged view of part A of FIG. 3.

Referring to FIGS. 2 and 3 again, the top cover 1 is made in the shape of a half-round shell comprising a circular hole 11 in the center, a plurality of retaining slots 12 spaced around the circular hole 11, and a plurality of inside notches 14 spaced at the bottom around the border. The button 13 fitted into the circular hole 11, having a plurality of bottom hooks 131 respectively hooked in the retaining slots 12. The motor holder 2 comprises a plurality of wedge blocks 21 respectively engaged into the inside notches 14. The fan guard 25 comprises a plurality of exhaust holes 251, a screen filter 26 covered over the exhaust holes 251 to remove dust from air passing through, and two mounting holes 27 bilaterally disposed at the bottom. The bottom shell 3 comprises two upright retainer rods 32 spaced at the top and respectively engaged into the two mounting holes 27 on the fan guard 25, a plurality of ventilation tubes 33 and a plurality of teeth 31 are alternatively and equally spaced at the bottom and disposed in reversed directions. Each ventilation tube 33 has an annular groove 331 near the respective top edge for mounting the partition plate 4. The partition plate 4 is made from plastic, and has a plurality of holes 41. By inserting the ventilation tubes 33 into the holes 41, the partition plate 4 is suspended on the annular grooves 331 of the ventilation tubes 33 and spaced above the bottom shell 3 (see FIG. 4). Therefore, a storage space is defined between the bottom shell 3 and the partition plate 4. The switch 5 comprises a first contact metal plate 51 and a second contact metal plate 51' respectively connected to the two opposite ends of the battery set 231 being held in the battery chamber 23, two plate springs 511;511' respectively spaced above the first and second metal contact plates 51;51' and engaged against the button 13 of the top cover 1 at the bottom.

Figure 5:
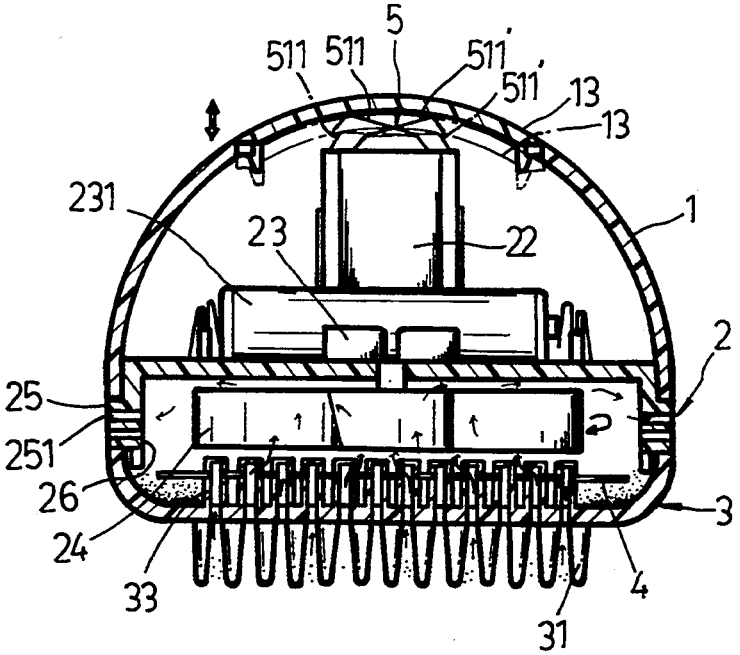
Figure 6:
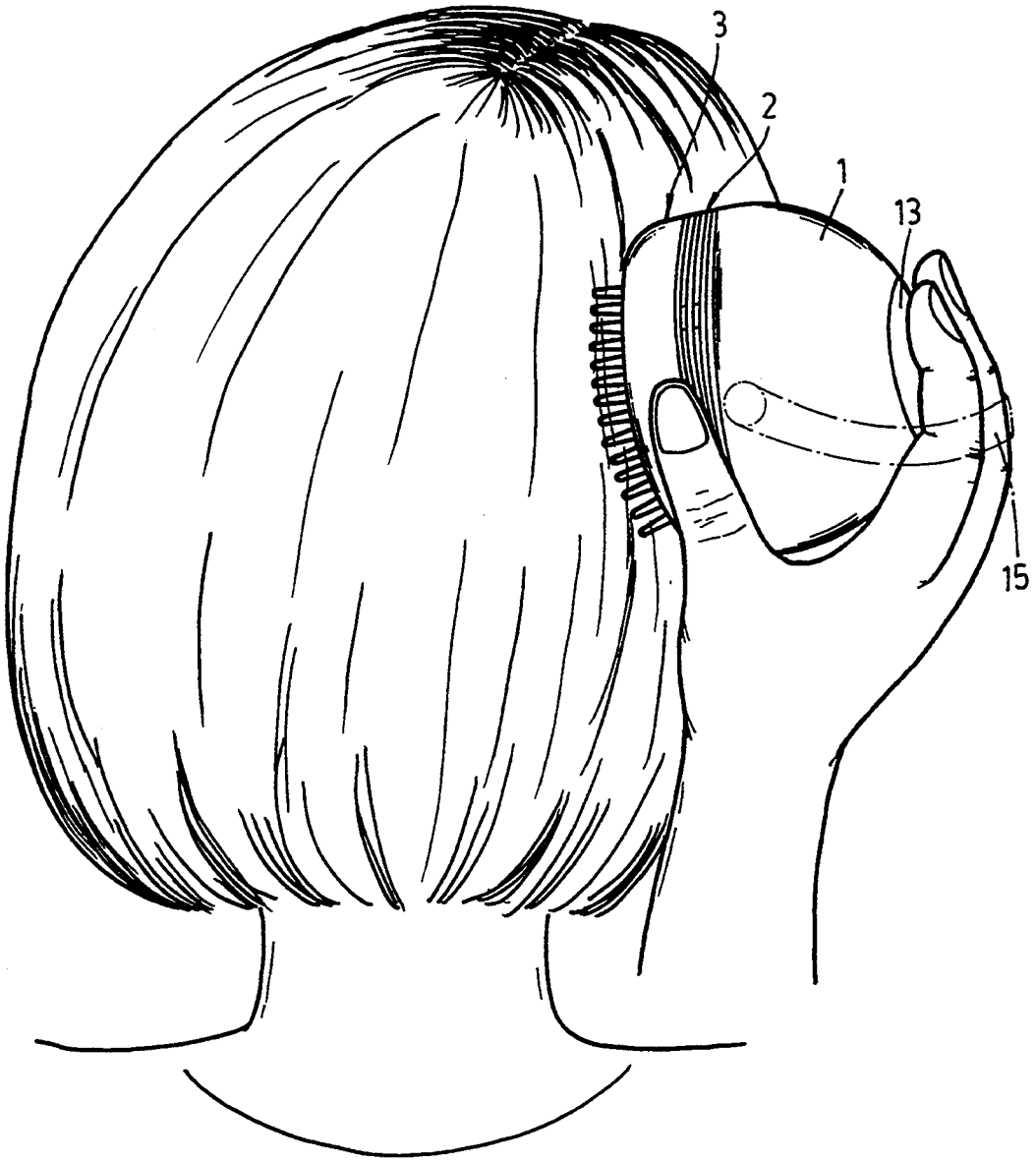
FIG. 6 shows the hair cleaning device moved to clean the hair.

Referring to FIGS. 5 and 6, a belt 15 may be fastened to the top cover 1 to hold the hand in position as the hand is holding the hair cleaning device to comb the hair. As the button 13 is pressed, the plate springs 511;511' are moved downward to contact the first and second metal contact plates 51;51', and therefore the switch 5 is switched on to turn on the motor 22 and the fan blade 24 to produce an induced draft for sucking up dust and dandruff from the hair into the bottom shell 3 through the ventilation tubes 33. After passing through the ventilation tubes 33, the induced draft immediately flows out of the device through the exhaust holes 251 on the fan guard 25. The output end 332 of each ventilation tube 33 is disposed at the top and turned sideway to prevent the tail of the hair from being drawn into the bottom shell.

What is claimed is:

1. A hair cleaning device comprising:

a top cover comprising a circular hole in a center thereof, a button mounted in said circular hole, and a plurality of inside notches spaced around a border of said cover at a bottom thereof;

a motor holder covered by said top cover, said motor holder comprising a plurality of wedge blocks spaced around a top of said holder and respectively engaged into said inside notches, a motor disposed at the top of said holder, a DC power supply, a switch connected between said motor and said DC power supply and controlled by said button on said top cover, and a fan blade disposed at a bottom of said holder and driven by said motor to produce an induced draft;

a fan guard fastened to said motor holder around said fan blade, said fan guard comprising a plurality of exhaust holes, a screen filter covered over said exhaust holes, and two mounting holes at two opposite locations;

a bottom shell fastened to said fan guard at the bottom, said bottom shell comprising two upright retainer rods respectively engaged into said mounting holes on said fan guard, a plurality of ventilation tubes extending upward from a bottom of said bottom shell for passing air, and a plurality of teeth extending downward from the bottom of said bottom shell for combing the hair; and a partition plate mounted on said ventilation tubes and spaced above the bottom of said bottom shell and disposed between said fan blade and said bottom shell, said partition plate having a plurality of mounting holes into which said ventilation tubes respectively fit.

2. The hair cleaning device of claim 1 wherein each ventilation tube has an output end disposed at the top, the output end being directed sideways.

3. The hair cleaning device of claim 1 further comprising a fastening belt mounted on said top cover for securing a hand during use of the device.

* * * * *